US006301815B1

(12) United States Patent
Sliwa

(10) Patent No.: US 6,301,815 B1
(45) Date of Patent: Oct. 16, 2001

(54) FIREARMS AND DOCKING STATION SYSTEM FOR LIMITING USE OF FIREARM

(75) Inventor: Steven M. Sliwa, West Hartford, CT (US)

(73) Assignee: Colt's Manufacturing Company, Inc., West Hartford, CT (US)

( * ) Notice: Subject to any disclaimer, the term of this patent is extended or adjusted under 35 U.S.C. 154(b) by 0 days.

(21) Appl. No.: 09/263,438

(22) Filed: Mar. 4, 1999

(51) Int. Cl.[7] ..... F41A 17/00
(52) U.S. Cl. ..... 42/70.01; 42/70.05; 42/70.11
(58) Field of Search ..... 42/70.01, 70.05, 42/70.08, 70.11

(56) References Cited

U.S. PATENT DOCUMENTS

| | | | | |
|---|---|---|---|---|
| 4,467,545 | | 8/1984 | Shaw, Jr. | 42/70 |
| 5,192,818 | | 3/1993 | Martin | 42/70.01 |
| 5,301,448 | | 4/1994 | Petrick et al. | 42/70.01 |
| 5,416,472 | * | 5/1995 | Torii, Jr. | 42/70.11 |
| 5,448,847 | | 9/1995 | Teetzel | 42/70.08 |
| 5,459,957 | * | 10/1995 | Winer | 42/70.11 |
| 5,461,812 | | 10/1995 | Bennett | 42/70.11 |
| 5,502,915 | | 4/1996 | Mendelsohn et al. | 42/70.11 |
| 5,517,780 | * | 5/1996 | Haber et al. | 42/70.01 |
| 5,603,179 | | 2/1997 | Adams | 42/70.08 |
| 5,611,164 | | 3/1997 | Rassias | 42/70.11 |
| 5,621,996 | | 4/1997 | Mowl, Jr. | 42/70.07 |
| 5,636,464 | | 6/1997 | Ciluffo | 42/70.11 |
| 5,675,925 | | 10/1997 | Wurger | 42/70.11 |
| 5,704,151 | | 1/1998 | West et al. | 42/70.07 |
| 5,704,153 | | 1/1998 | Kaminski et al. | 42/70.11 |
| 5,713,149 | | 2/1998 | Cady et al. | 42/70.06 |
| 5,915,936 | * | 6/1999 | Brentzel | 42/70.11 |
| 5,937,557 | * | 8/1999 | Bowker et al. | 42/70.01 |

* cited by examiner

*Primary Examiner*—J. Woodrow Eldred

(57) ABSTRACT

A gun and a base unit such that the gun cannot be fired unless the gun comes in close contact with the base unit and the base unit determines that an authorized person is holding the gun and interfacing with the base unit. The base unit pre-records and stores characteristics of authorized persons and unauthorized person and compares these data with the person interfacing with the base unit. The gun must be gripped to be activated by the base unit and if it is put down, the gun is no longer capable of being fired. The base unit can use multiple means of identifying an individual and a process is described for combining the results from the multiple sources to determine if a person is an authorized person above a selectable threshold of probability. The base unit can also develop a probability that the person attempting to use the gun is a specified unauthorized person. Thresholds of being an authorized person or not being an unauthorized person can be adjusted.

25 Claims, 13 Drawing Sheets

FIG. 3
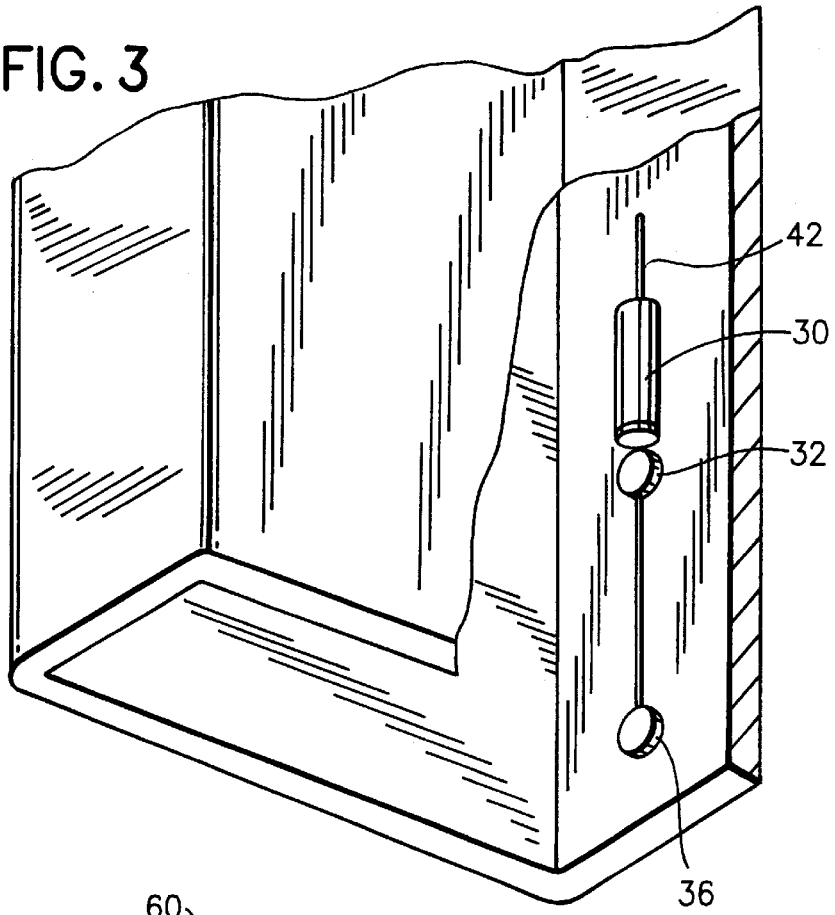
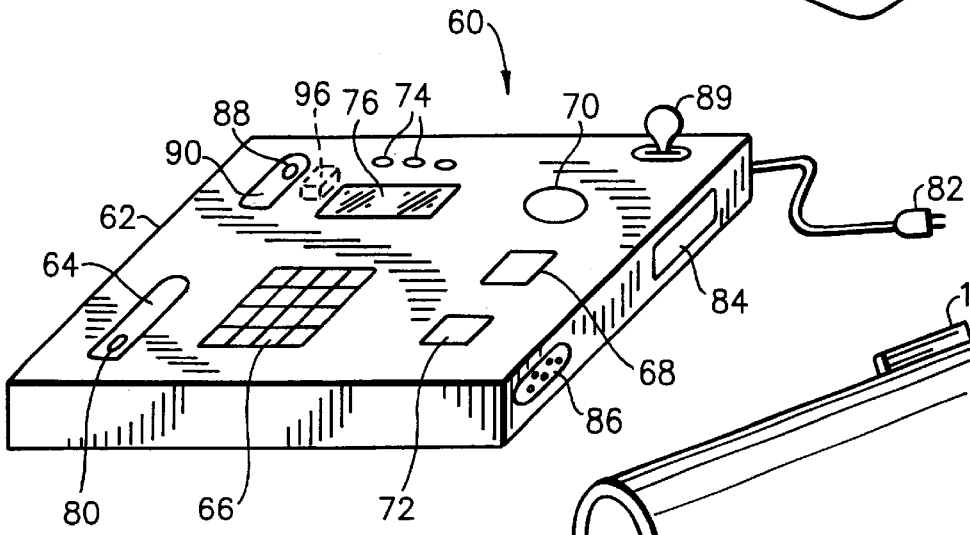
FIG.4
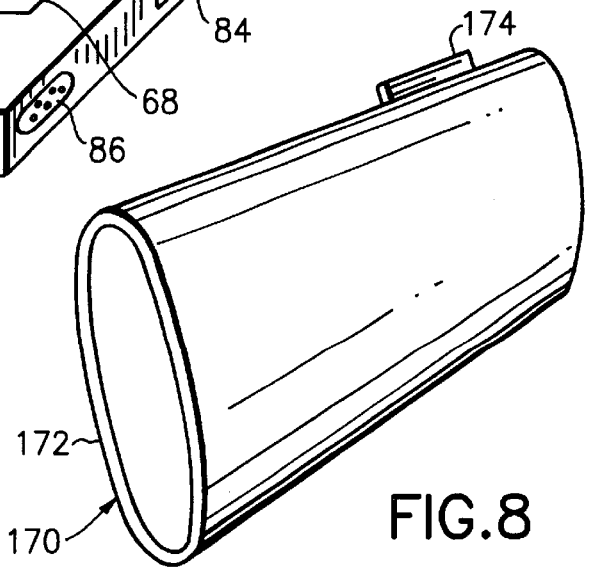
FIG.8

FIREARMS AND DOCKING STATION SYSTEM FOR LIMITING USE OF FIREARM

BACKGROUND OF THE INVENTION

1. Field of the Invention

The present invention relates to firearms and, more particularly, to a safety system for a firearm.

2. Prior Art

U.S. Pat. No. 5,704,153 discloses a firearm safety system which can communicate with a programming unit. U.S. Pat. No. 5,192,818 discloses a firearm with a timer preventing a firearm from being fired again. U.S. Pat. No. 5,502,915 discloses a firearm which recognizes a hand print of an authorized user. U.S. Pat. No. 5,636,464 discloses an audio controlled gun locking mechanism.

Firearms, rifles and handguns are potentially dangerous mechanisms especially if misused. During the past centuries of firearm development mechanical safeties have been employed to help prevent the accidental firing of a weapon. Recently there has been a call for technologies which prevent a gun from being used by unauthorized users.

The goal of such technology is that a gun could be stored in a person's bedroom, for example, and be available for personal defense against intruders. However, the same weapon stored in such a manner cannot be used by other unauthorized members of the household, for example, children. Similarly, if the gun is taken from its storage location or from the owner, it cannot be used against members of the household. Ideally the gun would also be rendered useless by unauthorized users outside of the home or business.

The first such examples of trying to limit the use of guns to authorized users are gun safes. These are safes which permit the introduction of guns and can be locked. Unlocking the safe is either by putting the proper combination into a combination lock or by using a key or both by authorized users. The disadvantage is that it takes too long to get to the safe and unlock it if an intruder is detected. Once a gun is taken from the safe and if it is not returned, others can gain access and improperly use the gun. Additionally, the gun can be taken from the user and used against him or her. Finally, if an unauthorized person in the household or the business can gain access to the combination or the key, he/she can gain access to a loaded weapon for improper use.

Another example of an attempt at making guns safer from unauthorized users is the use of gun locks. Gun locks are separate devices which are added to the guns and can be locked by key or combination lock. The user unlocks the gun lock and the gun is available for normal use. The problem is that it takes time to find the key or put in the combination number. Once the gun is unlocked it can be taken from the user and used against him or her. Additionally, if the gun is put down and not locked, it can be used against the user. Finally, if an unauthorized person in the household or business can find the key or the combination, he/she can gain access to the weapon and use it improperly.

The next common attempt at providing gun safety is through the use of lockable boxes. Lockable boxes are containers which hold the guns and can be locked by a combination lock or keyed lock. Applying the combination or the key to the lock unlocks the box and makes it available for use. The disadvantage is that it takes too long to unlock the box if an intruder to the household or business is detected. Once a gun is taken from the safe and if it is not returned, others can gain access and improperly use the gun. Additionally, the gun can be taken from the user and used against him or her. Finally, if an unauthorized person in the household or the business can gain access to the combination or the key, he/she can gain access to a loaded weapon for its improper use.

An example of a gun system for authorized users are magnetic locks which prevent a gun from being fired unless the user is wearing a specially magnetized ring. This device has many shortcoming including unreliable operation, the disadvantage of not being able to be fired from either hand, and many users do not want to have to wear a ring on any hand.

Another proposal is that of a mechanical combination integrated into the gun. This has the disadvantage of being impractical to build into a gun for providing a locking mechanism that is unlocked by the combination. Once the gun is unlocked, it must be manually locked otherwise it will be left in an unsafe condition. If a criminal takes an unlocked gun from the user it remains unlocked. Additionally, if an unauthorized person in the household can gain access to the combination is can be unlocked and used improperly by the unauthorized person.

Another proposal is that the gun is electromechanically locked and will not be capable of being operated unless it is in the appropriate proximity of a radio frequency transmitter. This transmitter could be in a watch, ring, or wristband. The disadvantage of this approach is that it requires wearing a watch, ring or wristband. If an unauthorized person in the household or business can gain access to these items they can improperly use the weapon. Additionally, building radio transmission equipment for close proximity to weapons firing results in loss of reliability and longevity of service.

Another proposal is that the gun is electromechanically locked and will not be capable of being operated unless an appropriate fingerprint is detected. The problem with this approach is that is does not work with persons wearing gloves, requires alot of onboard processing and data collection, and it is difficult to build robust enough to withstand day-to-day carrying use, such as by a police officer. Fingerprint processing is an intense computation difficult to package in the small locations available on a gun and with the limited electrical power capacity. Additionally, once the gun has been armed it remains so even if taken away by an intruder. A big concern of this design is that the technology will not positively identify the authorized person reliably enough and fast enough to insure that the gun is available for personal defense.

In general, all of these previous approaches have shortcomings for the application of improving the safety of firearms. Each suffers from one or more of the following disadvantages:

(a) Access to the gun is clumsy and slow making it less suitable for personal defense from intruders;

(b) Once the gun is unlocked it can be set down and used by an unauthorized person unless it is specifically locked by the authorized person;

(c) An unauthorized person can gain access to the combination of the lock or the key of the lock and use the gun improperly;

(d) Once the gun has been unlocked a criminal can take the gun away from the authorized user and use the gun against him/her;

(e) Users may not want to wear rings, watches, or wristbands;

(f) Users may want to wear gloves;

(g) Onboard processors of sensor data for biometric identification measures (e.g., fingerprints) are difficult to built on a gun with close proximity to the explosions of the gun firing;

(h) Locating onboard processors for processing is difficult to perform in the compact locations available on a gun with limited power;

(i) Processing of fingerprints and other biometric identification measures to identify an authorized user is difficult to perform reliably to insure that unauthorized users can not also gain access while reliably positively identifying authorized users.

SUMMARY OF THE INVENTION

In accordance with one embodiment of the present invention a firearm is provided having a frame, a barrel connected to the frame, a firing mechanism connected to the frame, and a safety system connected to the firing mechanism. The safety system comprises a firing mechanism interrupter and a firing mechanism interrupter control system. The interrupter is connected to the frame. The interrupter is moveable between a firing position which allows the firing mechanism to fire the firearm and a safe position which prevents the firing mechanism from firing the firearm. The interrupter control system is connected to the interrupter for controlling movement of the interrupter between the firing position and the safe position. The control system comprises a user actuated switch and an input. The control system controls the interrupter such that after the user actuated switch is actuated, while a signal is received at the input, the interrupter is moved to the firing position until the user actuated switch is released by the user, whereupon the interrupter is moved to the safe position until both the user actuated switch is actuated again while the signal is also received at the input again.

In accordance with another embodiment of the present invention a firearm system is provided comprising a firearm, and a docking station. The firearm has a safety system. The docking station is for communicating with the safety system of the firearm. The firearm system further comprises means for initially moving the safety system to a firing position while the docking station communicates with the safety system, means for subsequently maintaining the safety system in the firing position, after the means for initially moving has moved the safety system to the firing position, while a user contacts a portion of the firearm, and means for moving the safety system from the firing position to the non-firing position to prevent the firearm from firing when the user releases contact from the portion of the firearm and for maintaining the safety system at the non-firing position until the means for initially moving the safety system is used again to move the safety system back to the firing position.

In accordance with one method of the present invention a method for enabling and disabling a firing mechanism of a firearm is provided comprising the steps of enabling the firing mechanism by placing the firearm in a firearm docking station and actuating a user actuated switch on the firearm to thereby move a safety system of the firearm to the firing position; removing the firearm from the docking station while the user actuated switch is actuated, the safety system being continuously maintained in the firing position while the user actuated switch is continuously actuated after removal of the firearm from the docking station; and disabling the firing mechanism by deactuating the user actuated switch by the user to thereby move the safety system to a safe position to prevent the firing mechanism from firing and maintain the safety system in the safe position until the firearm is once again placed in the docking station and the firing mechanism enabled again.

BRIEF DESCRIPTION OF THE DRAWINGS

The foregoing aspects and other features of the present invention are explained in the following description, taken in connection with the accompanying drawings, wherein:

FIG. 3 is a cut away view of a portion of the firearm shown in FIG. 1 at its magazine receiving area;

FIG. 4 is a perspective view of a firearm docking station incorporating features of the present invention;

FIG. 8 is a perspective view of an alternate embodiment of the docking station;

DETAILED DESCRIPTION OF THE PREFERRED EMBODIMENT

Figure 1:
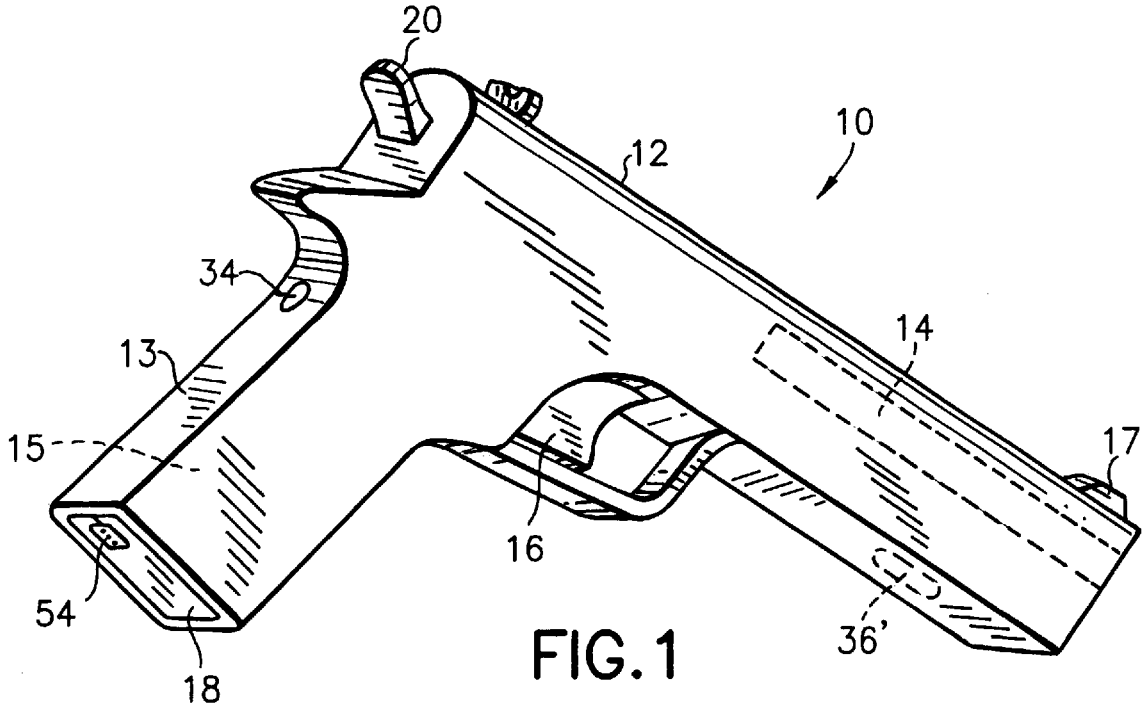
FIG. 1 is a perspective view of a firearm comprising features of the present invention.

Referring to FIG. 1, there is shown a perspective view of a firearm 10 incorporating features of the present invention. Although the present invention will be described with reference to the embodiment shown in the drawings, it should be understood that the present invention can be embodied in many alternate forms of embodiments. In addition, any suitable size, shape or type of elements or materials could be used.

Figure 1A:
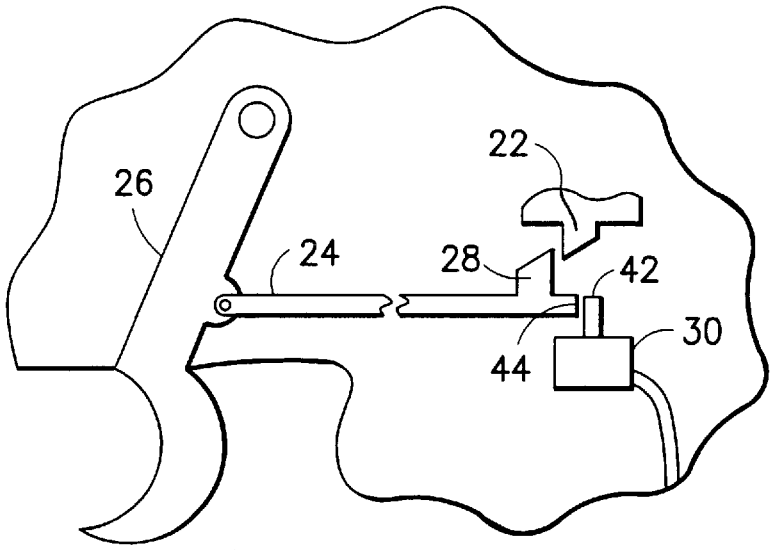
FIG. 1A is a schematic partial view of portions of the firearm mechanism of the firearm shown in FIG. 1.

The firearm 10 is a pistol having a frame 12, a barrel 14, a firing mechanism 16 and an ammunition magazine 18. However, in alternate embodiments features of the present invention could be incorporated into other types of firearms. The firearm 10 also comprises a safety system which is connected to the firing mechanism. U.S. Pat. No. 5,704,153 and U.S. patent application Ser. No. 09/152,547, which disclose safety systems for firearms, are hereby incorporated by reference in their entireties. Referring also to FIG. 1A, the firing mechanism 16 generally comprises a hammer or striker 20 (see FIG. 1), a hammer sear 22, a trigger bar 24 and a trigger 26. In alternate embodiments other types of firing mechanisms could be used. The trigger bar 24 has a sear 28 for interacting with the hammer sear 22 to cock and release the hammer 20 when the trigger 26 is pulled by a user.

Figure 1B:
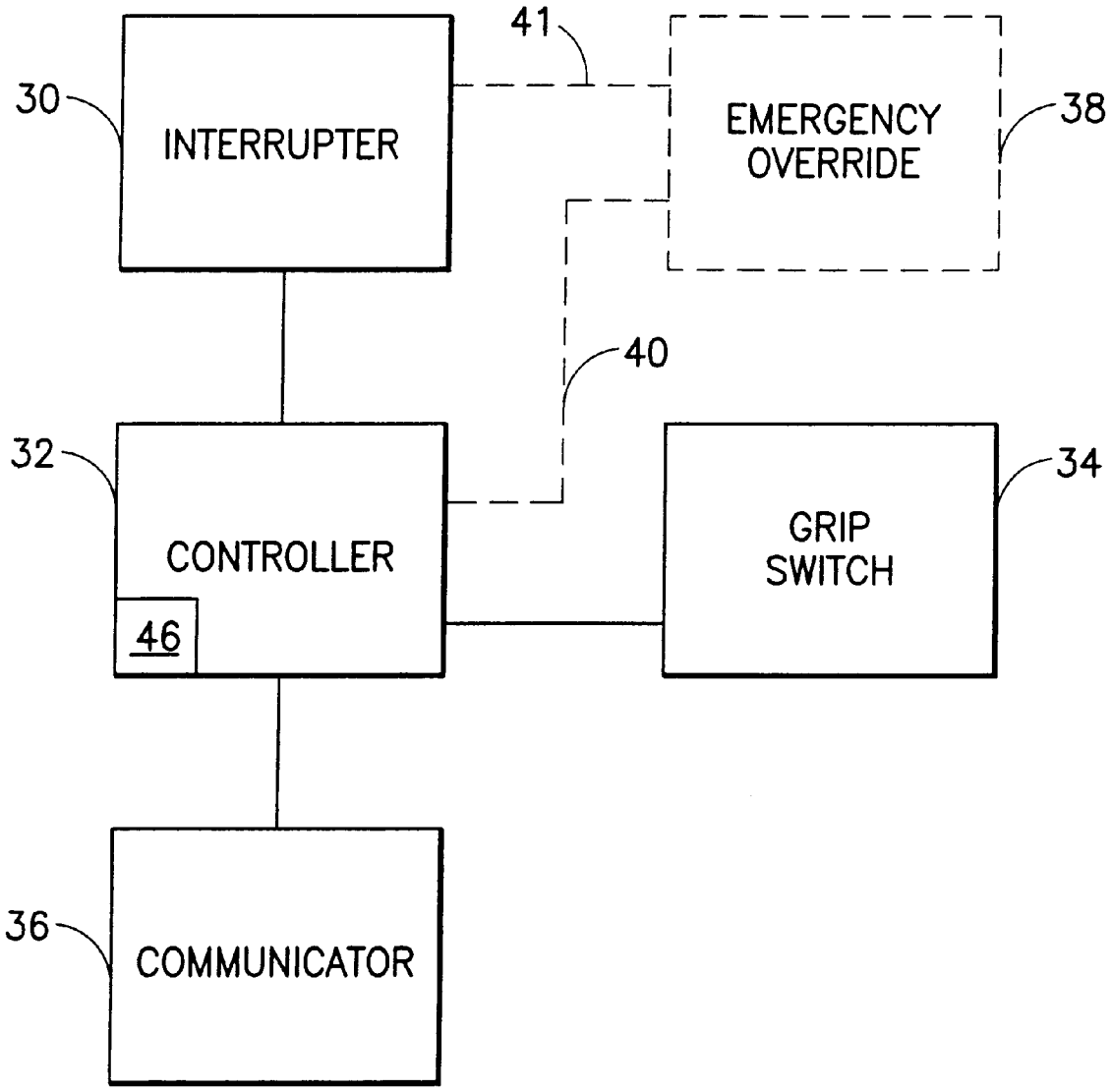
FIG. 1B is a schematic block diagram of the safety system used in the firearm shown in FIG. 1.

Referring also to FIG. 1B, the safety system comprises a blocker or interrupter 30, a controller 32, a grip switch 34 and a communicator 36. The safety system may also have an optical emergency override system 38 electrically connected to the controller and/or mechanically connected interrupter 30 as illustrated by lines 40 and 41, respectively. The emergency override could be push buttons on the frame or any other suitable mechanism for inputting a code manually by a user into the safety system to allow the firearm to be fired. The interrupter 30, in this embodiment, has a moveable blocking section 42 which can be moved into and out of the path of the rear end 44 of the trigger bar 24. In alternate embodiments the interrupter could move the trigger bar 24 or otherwise cause the trigger bar to not engage and release the hammer 20. Any suitable type of interrupter could be provided and adapted to prevent a firearm from firing when the trigger is pulled by a user including a solinoid or a micro-motor. The interrupter 30 is preferably electrically operated, buy may also be mechanically actuatable such as with the emergency override system 38. The interrupter 30 is connected to the controller 32 which is, in turn, connected to the communicator 36.

The controller 32 is preferably a microprocessor with a memory 46, but any suitable controller could be provided. The grip switch 34 is also connected to the controller 32. The grip switch 34 is mounted to the frame 12 at the hand grip section 13. The switch 34 is adapted to be actuated when a user contacts the switch 34 as the user grasps the hand grip section 13. The switch 34 then sends a signal to the controller 32 which indicates that the user is grasping the hand grip section. In an alternate embodiment the grip switch could be a mechanical device which mechanically interacts with the interrupter 30, trigger bar 24 and/or another component of the firing mechanism.

The communicator 36 is an electrical connector located inside the magazine receiving area 15 of the frame 12. In alternate embodiments the communicator 36 could be an electrical connector on the outside of the frame 12, could be a magnetic read switch, could be a radio frequency receiver or transceiver, or could be a magnetic reader for receiving a coded magnetic signal. The communicator 36 is electrically connected to the controller 32.

Figure 2:
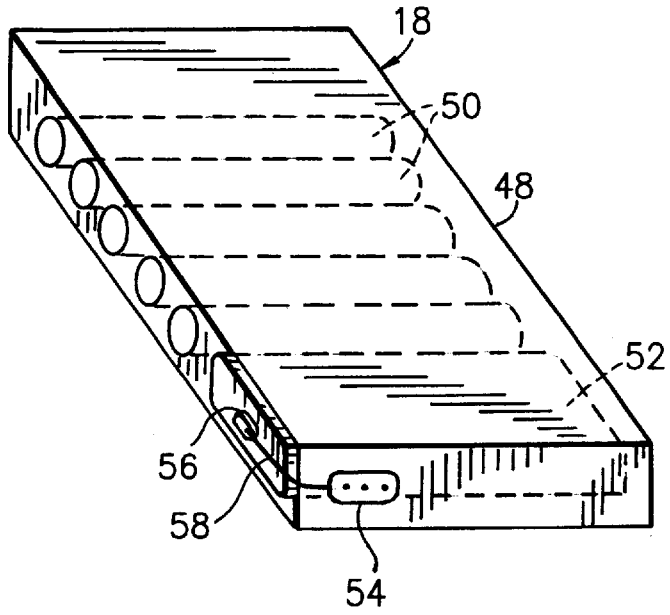
FIG. 2 is a perspective view of the ammunition magazine used in the firearm shown in FIG. 1.

Referring also to FIG. 2, the ammunition magazine 18 generally comprises a frame 48 for housing cartridges 50, a spring loaded follower (not shown) inside the frame, a battery 52, and two electrical connectors 54, 56 on the frame 48. The first connector 54 is on the bottom of the frame 48. The second connector 56 is on the rear of the frame 48. A wire 58 connects to the two connectors 54, 56 to each other. The battery 52 is also connected to the second connector 56. Preferably, both connectors 54, 56 have multiple separate electrical contact pads. Referring also to FIG. 3, the inside of the firearm at the magazine receiving area 15 is shown. The connector 36 is located at the receiving area 15. When the magazine 18 is inserted into the area 15 the second connector 56 makes electrical connection with the connector 36. Thus, the controller 32 is electrically connected to the battery 52 and the first connector 54. In an alternate embodiment the magazine 18 and/or the firearm 10 need not have a battery. A battery could also be located in the firearm separate from the magazine. The firearm 10 could also have the connector 36 on the outside of the frame 12, such as when the firearm is designed to use a standard type of old style cartridge magazine. The connector 36 could alternatively be a proximity sensor and/or could be located anywhere on the firearm 10. The grip switch 34 could also be located at any suitable location on the firearm.

Referring also to FIG. 4 a docking station 60 for use with the firearm 10 is shown. The docking station generally comprises a housing 62 having a firearm receiving area 64, user input devices 66, 68, 70, 72 and display devices 74, 76.

The input devices generally comprise a keypad 66, a fingerprint scanner 68, a microphone 70, and an optional other biometric sensor 72. As used herein the term "biometric" is intended to mean biometry or the mathematical analysis of biological data. Different types of biometric information could be voice or fingerprints. A biometric identification sensor would be a sensor for sensing biometric information, such as the microphone 70 or scanner 68. The docking station uses biometric information for identification purposes as described below. In alternate embodiments biometric input devices or sensors need not be provided on the docking station. Biometric sensors could alternatively or additionally be provided on the firearm 10. In another alternate embodiment the docking station 60 need not have any user input devices or displays.

Figure 5:
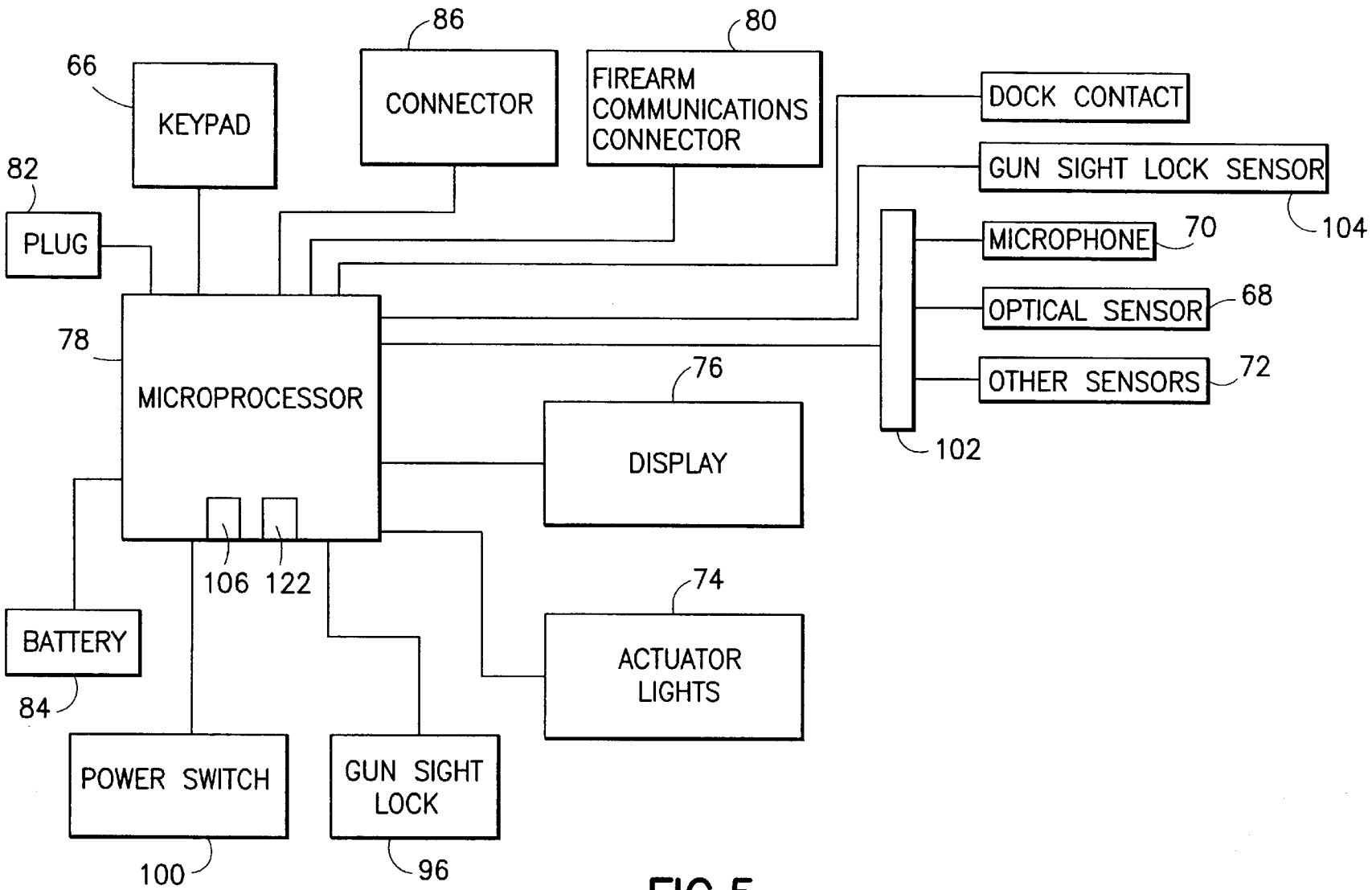
FIG. 5 is a schematic diagram of components used in the docking station shown in FIG. 4.

Referring also to FIG. 5, the docking station has a controller 78 such as a microprocessor. The firearm receiving area 64 includes an electrical connector 80 which is connected to the controller 78. In alternate embodiments the connector 80 could be an optical connector for sending optical signals, a magnetic connector for sending magnetic coded signals, or a radio frequency transmitter. In the embodiment shown the firearm 10 is intended to be placed in the firearm receiving area 64 with the connector 54 of the firearm making electrical connection with the connector 80. Thus, the docking station controller 78 can send signals to the firearm safety system controller 32 when the firearm 10 is connected to the docking station 60. For the alternate embodiments of use of radio frequency communication or magnetic coded signal communication the firearm need not to mounted to the docking station, but merely be in close proximity thereto. The docking station is preferably powered by ordinary household electrical current and is plugged into an electrical outlet by plug 82. Alternatively, the docking station could be battery powered. In the embodiment shown the docking station has a battery 84 as a back-up power supply in the event of a blackout or loss of main power supply. However, the battery 84 need not be provided. In this embodiment the docking station 60 also has an electrical connector 86, such as a universal serial bus (USB) connector for connecting electronics of the docking station to a computer or printer (not shown). Thus, data, programming, or information can be transferred to and from the electronics of the docking station 60. However, the communications connector 86 need not be provided. The docking station 60 also can have a gun lock 88 as shown in this embodiment. In this embodiment the gun lock 88 is designed to interact with the front end of the firearm 10 at the muzzle end of the barrel 14 and with the front sight 17. The housing 62 has a receiving area 90 for receiving the front end of the firearm 10 while the bottom end of the firearm, at the bottom of the handgrip section 13, rests at the receiving area 64.

Figure 4A:
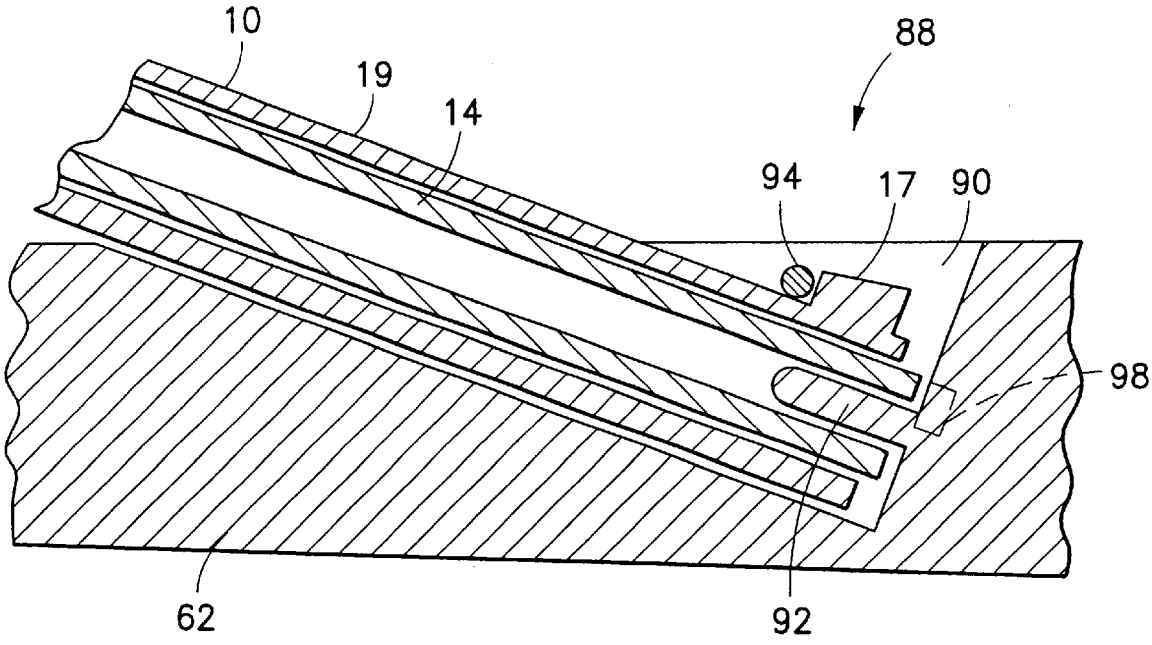
FIG. 4A is a partial cross-sectional view of a portion of the docking station shown in FIG. 4.

Referring also to FIG. 4A, the front end receiving area 90 has a stationary positioning pin 92 which forms part of the lock 88. The lock 88 also comprises a longitudinally moveable pin or bar 94. The bar 94 is connected to a motor 96 (see FIG. 4) inside the housing 62. The motor 96 is connected to the controller 78 and is adapted to move the bar 94 between a retracted unlock position and an extended locking position. In the extended locking position the bar 94 extends across the width of the receiving area 90. In the retracted position the bar 94 is fully retracted from the area 90 into the housing 62. In order to insert the firearm 10 into the area 90 the bar 94 must be in its retracted position. The barrel 14 is positioned on the pin 92 as shown. The controller 78 then moves the bar 94 to its extended locking position. The controller 78 could be initiated to move the bar 94 such as by a switch (not shown) actuated by the user, the user pressing one of the keys of the keypad 66, an automatic system such as a switch 98 contacted by the firearm when the firearm 10 is positioned on the pin 92, or any other suitable activation system. When the bar 94 moves to its extended locking position it locates itself over the top side of the slide 19 directly behind the rear end of the front sight 17. The combination of the shape of the area 90, the pin 92 in the barrel 14, and the bar 94 behind the front sight 17 locks the firearm to the housing 62. When the controller 78 moves the bar 94 to the retracted position, the firearm 10 can be moved from the area 90. In alternate embodiments the lock 88 need not be provided, or could be provided with alternative or additional structure or mechanical shapes or configurations. The lock could also be a purely mechanical system which is not electrically connected to the controller 78. The sight 17 could be modified to permit easier locking and unlocking if desired. The lock could also have a small serve mechanism which moves over and locks the gun on the gun sight 17. The docking station 60 could also have a key actuated mechanism 89 for moving the lock 88 and/or for turning the docking station (or a portion of the docking station) on and off. However, the key actuated mechanism need not be provided. As seen in FIG. 5, the docking station 60 has an on/off power switch 100. The switch 100 could be adapted to be actuated by the firearm 10 when the firearm is placed in the receiving area 64. The controller 78 is connected to the two displays 74, 76. In this embodiment the first display comprises a series of LED lights as indicators, such as green and red. The second display 76 is a panel display for text messages. However, in the alternate embodiments neither display need be provided or only one of the displays could be provided. The controller 78 is connected to a data bus 102 which is connected to the various sensors/input devices 68, 70, 72. Sensor 104 senses the position of the lock 88. In alternate embodiments the sensors/devices 68, 70, 72 could be separately connected to the controller 78 or could be connected to the controller in different groups with multiple data buses. In the embodiment shown, the controller 78 has a memory 106 and has programming which, based upon input from the keypad 66 and/or the sensors/devices 68, 70, 72, 98, 104, can (a) send a signal to the firearm communications connector 80, (b) control displays of the displays 74, 76, and (c) actuate the lock motor 96. The memory 106 can have stored identification information which the controller 78 can use to compare to input information for determining whether or not the person attempting to use the firearm 10 is an authorized user and/or unauthorized user. The stored information can include passwords, PIN numbers, and/or biometric identification data, or any other suitable identification data. Different types of biometric identification data stored in the memory could include fingerprints, voice recordings, body part heat signatures, retinal pictures, skin conductivity, etc. The stored biometric identification data could be of an authorized user, such as the owner, and/or of an unauthorized user, such as a child in a household where the docking station is located. Another stored biometric identification data of an unauthorized user could be of prison inmates if the docking station is located in a police station or correctional facility.

Figure 6A:
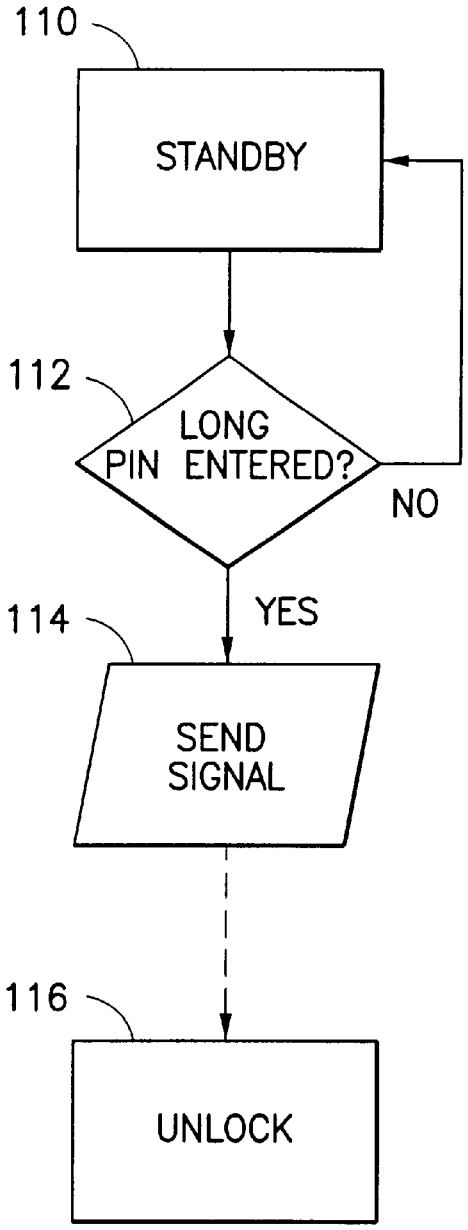
FIG. 6A is a flow diagram of one mode of operating the docking station shown in FIG. 4.

Referring now to FIG. 6A a flow diagram of one mode of operating the docking station 60 is shown. The docking station 60 would ordinarily be in a standby mode 110. In this standby mode no signal would be sent to the connector 80 from the controller 78. If the docking station has an automated lock, such as lock 88, the lock would be in a locking position. As indicated by block 112, if a long PIN (Personal Identification Number) number is entered by a user at the keypad 66, which matches a long PIN number stored in the memory 106, the controller 78 sends a signal to the connector 80 to be transmitted to the firearm 10 as indicated by block 114. If the entry at the keypad does not match the stored long PIN number, the docking station is maintained at a standby 110. If the docking station has an automated lock, upon entry of a long PIN number which matches a stored long PIN number, the lock could be moved to an unlock position by the controller 78 as indicated by block 116.

Figure 6B:
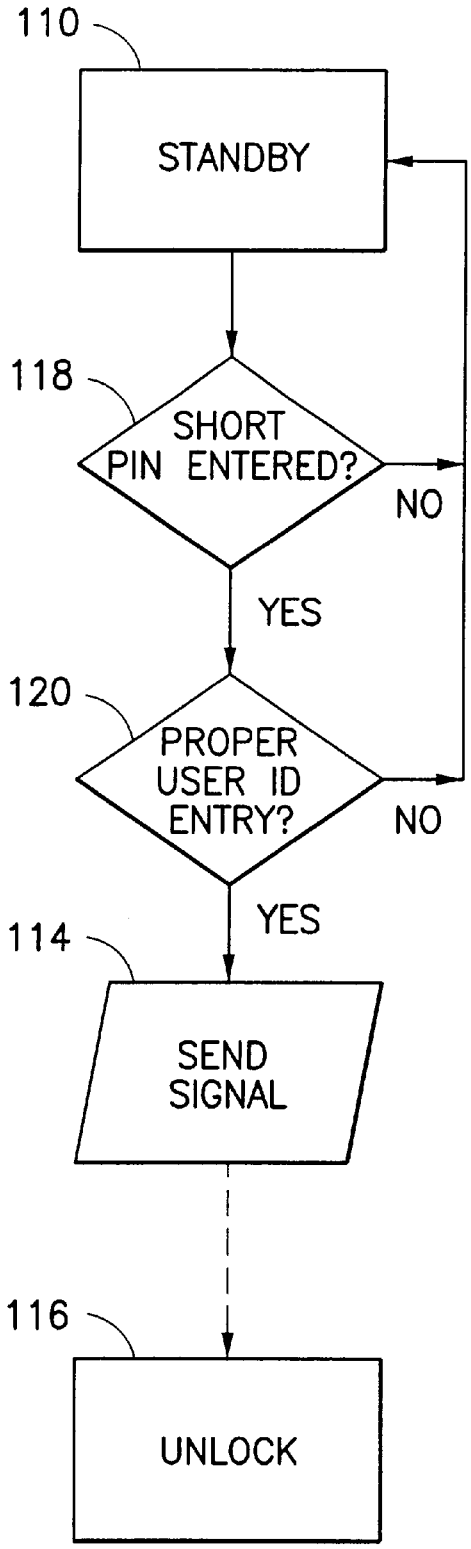
FIG. 6B is a flow diagram of another mode of operating the docking station shown in FIG. 4.

FIG. 6B shows a flow diagram of another mode of operating the docking station 60. As indicated by block 118, if a short PIN number is entered at the keypad 66 which matches a short PIN number stored in the memory 106 the controller then proceeds to block 120. A short PIN number could be as little as one, two, or three digits. A long PIN number would have more digits, such as six, seven, eight or more. PIN numbers can be pre-programmed by the manufacturer or the user. If a short PIN number is entered which does not match a stored short PIN number, the docking station remains in its standby mode. At block 120 the controller 78 compares identification data stored in the memory 106 to identification information input into one or more of the inputs 68, 70, 72. Also, probabilities can be associated with short or long PIN numbers so that the algorithm for combining biometric identification sensor probabilities can readily combine with the probabilities associated with correctly matching a PIN number. If the input identification information corresponds to stored identification data, such as a voice print, fingerprint or palm print, then the operation proceeds to block 114 and block 116 if the docking station has an automated lock. If the input identification information does not correspond to stored identification data, then the operation proceeds back to standby 110. The controller 78 could have a counter 122 which counts the number of consecutive time a correct matching short PIN number is entered, but an incorrect non-matching user identification information is entered and sound an alarm and/or lock down the lock 88 until the long PIN number is entered if the counted number exceeds a predetermined number, such as four or five. The controller 78 could also use the counter 122 to count the number of consecutive times an incorrect short PIN number is entered at the keypad 66, such as a ten, and sound an alarm and/or lock down the lock 88 and/or prevent a signal from being sent to the connector 80, until the long PIN number is entered.

Figure 6C:
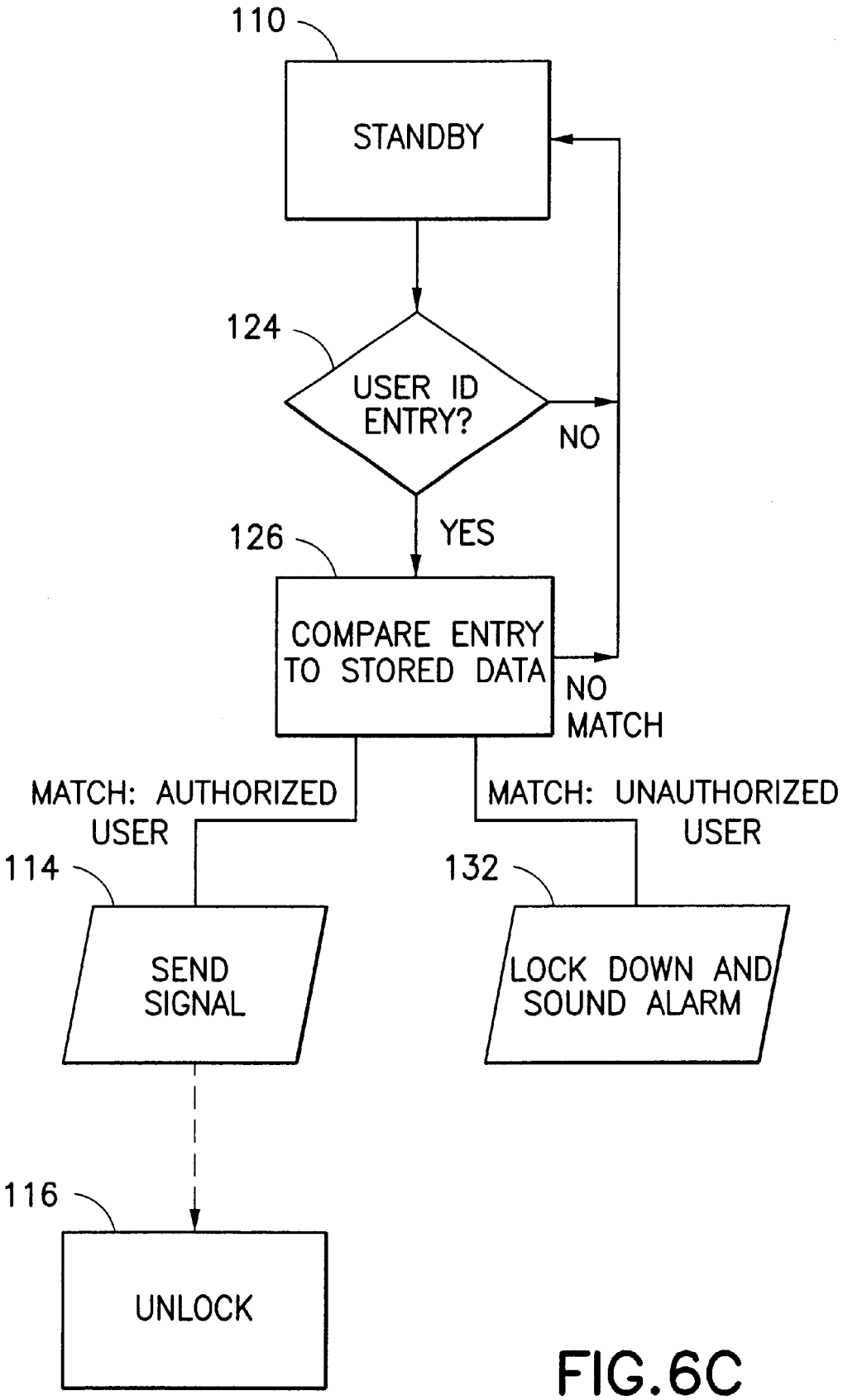
FIG. 6C is a flow diagram of another mode of operating the docking station shown in FIG. 4.

FIG. 6C shows an alternate mode of operation of the docking station which does not have or does not use a keypad. In this mode the memory 106 has authorized user identification data and unauthorized user identification data stored therein. At block 124 the controller determines if a user ID has been entered at one or more of the inputs 68, 70, 72. If not, then the docking station returns to standby 110. If a user ID has been entered, then the controller 78 compares the entered information to stored data at block 126. If there is no match, then the docking station returns to its standby mode 110. If the entered information matches stored unauthorized user data, then the docking station locks down and sounds an alarm as indicated in block 132. A lockdown could comprise doing one or more of the following until the docking station is reset (such as by entering a long PIN number or other reset procedure); locking the lock 88, preventing the controller from sending an authorization signal to the connector 80, or sending an unauthorized user signal to the connector 80. When an unauthorized user signal is used, the controller 32 in the firearm could keep the firearm safety system at a safe non-firing position. If the entered information at the inputs 68,70, 72 corresponds to stored authorized user data, then as indicated by block 114 the controller 78 sends a signal to the connector 80. The lock 88 may also be unlocked as indicated by block 116. The use of authorized/unauthorized user data or merely unauthorized user data may also be used in conjunction with a system having a keypad and stored PIN number(s).

Figure 6D:
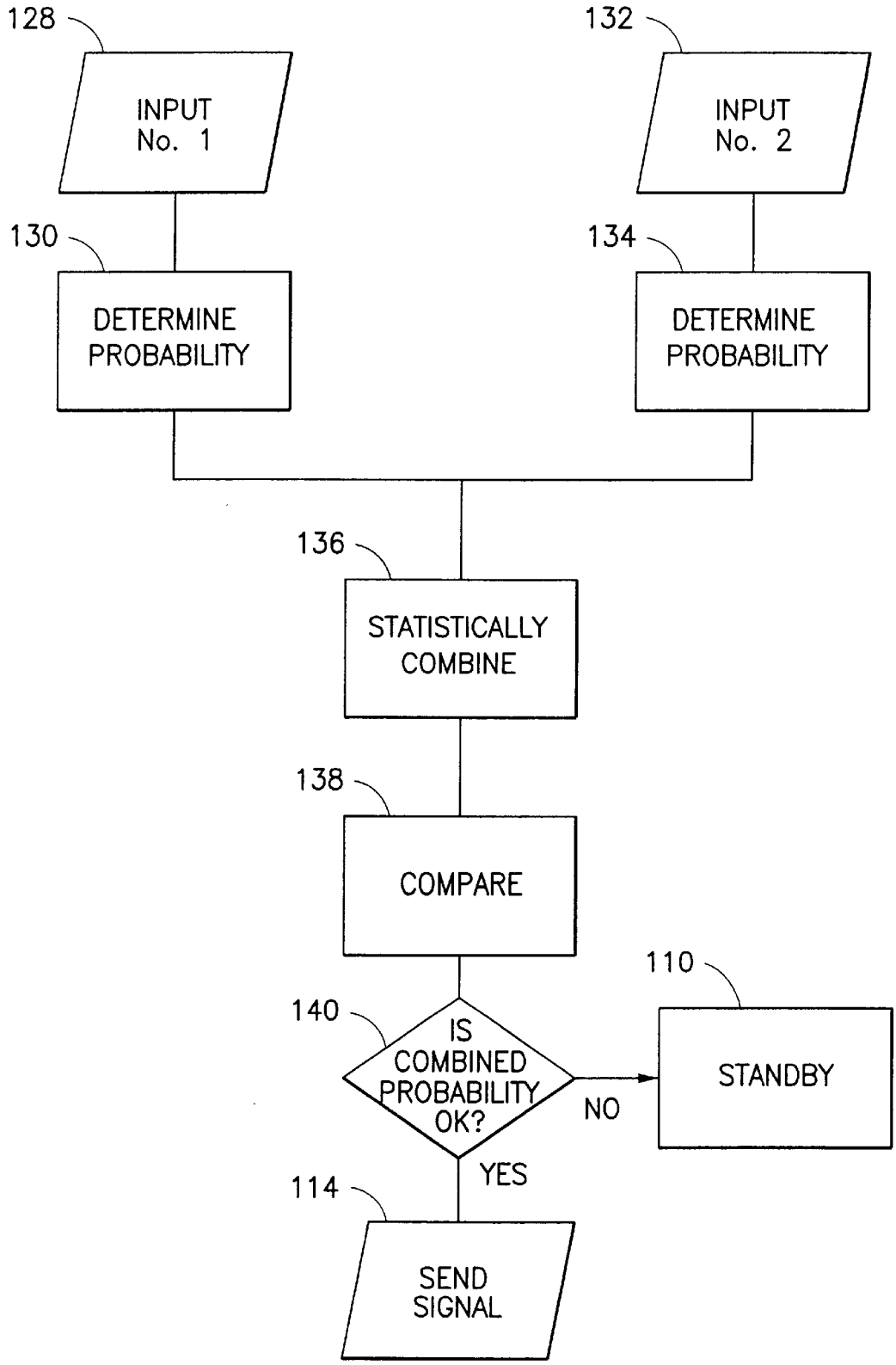
FIG. 6D is a flow diagram of another mode of operating the docking station shown in FIG. 4.

FIG. 6D shows another alternate mode of operation of the docking station. In this mode of operation the system uses probabilities and statistical combination mathematics to determine if a person attempting to use the firearm is an authorized user. The same types of use of probabilities and statistical analysis could also be used to determine if a person attempting to use the firearm is an unauthorized user. In this mode of operation a person inputs biometric information into one of the sensors 68, 70, 72 as indicated by block 128. The controller 78 then compares the input to stored data and determines a probability that the input information corresponds to stored data for an authorized user as indicated by block 130. Also, probabilities can be associated with short or long PIN numbers so that the algorithm for combining biometric identification sensor probabilities can readily combine with the probabilities associated with correctly matching a PIN number. For example, for a fingerprint, using fingerprint identification software, the controller 78 may be able to determine that there is a 70% probability that the input information corresponds to stored data for an authorized user. The controller 78 could use voice recognition software for use with the microphone, or any other suitable software for use with a respective appropriate biometric information input device. In addition to the probability generated at 130 from the first input 128 the system generates a second probability at 134 from a second input 132. This second input would be at one of the sensors 68, 70, 72 other than the sensor used for the first input 128. The two probabilities are then combined at block 136 by suitable statistical analysis software. For example, if the two probabilities from blocks 130 and 134 are 50% and 60%, respectively, the combined statistical probability might be 90% that the person attempting to use the firearm is an authorized user. At block 138 the controller would compare the combined statistical probability to a stored predetermined minimum biometric identification probability threshold, such as 60%, 70%, or by any other suitable percentage. There can also be a threshold probability for negative identification or, a threshold probability for the positive identification of an unauthorized user, such as a child in the household or a prisoner in a jail. The threshold probabilities for positive identification and negative identification can be adjusted by the manufacturer, the dealer, or perhaps the user depending upon the embodiment. At block 140 the controller 78 would return the system to standby 110 if the threshold probability was not met or exceeded or send the signal to the connector 80 if the threshold probability was exceeded. By using combined statistical probabilities the input devices 68, 70, 72 do not need to be expensive very accurate devices.

Figure 7A:
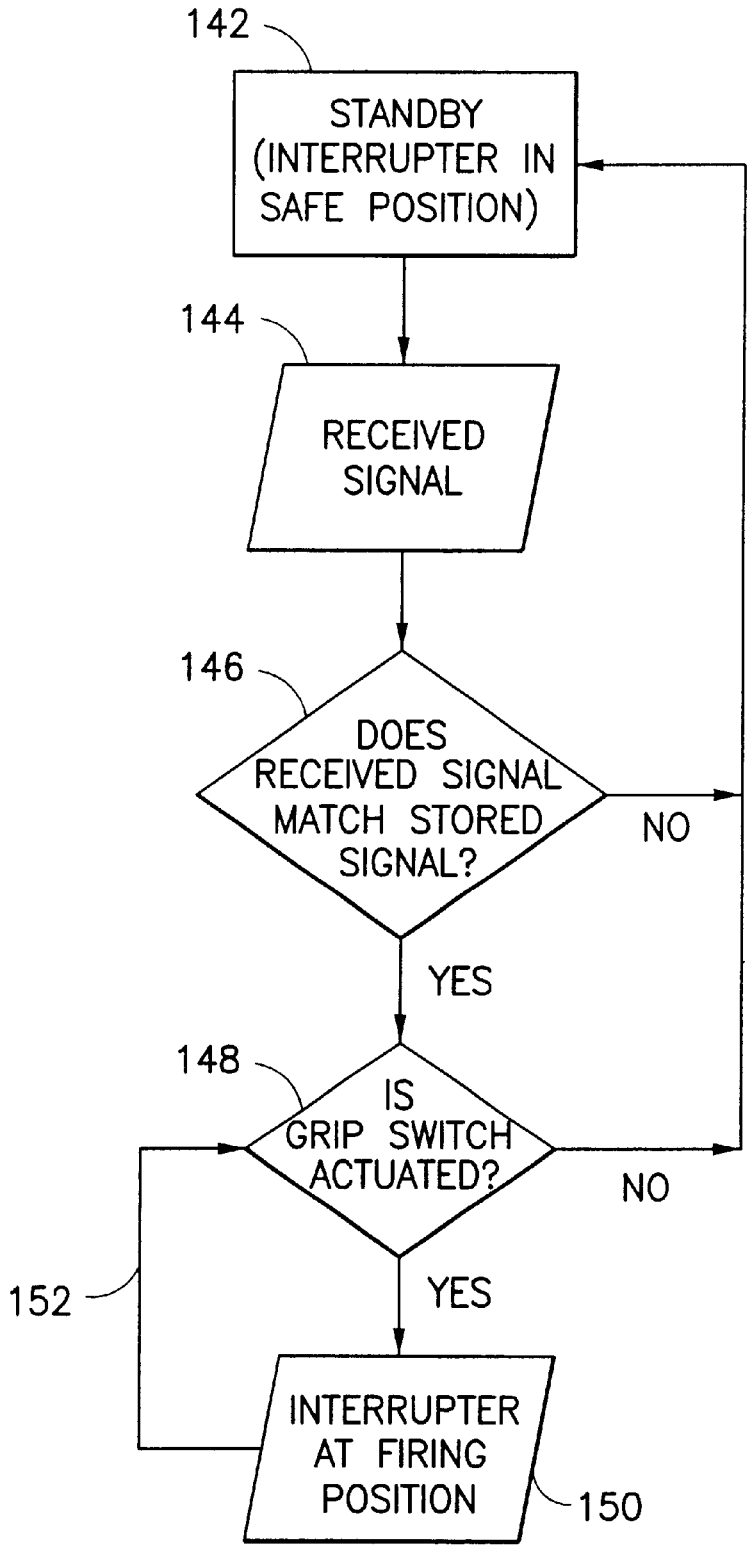
FIG. 7A is a flow diagram of one mode of operating the firearm component of the safety system shown in FIG. 1B with the docking station shown in FIG. 4.

Referring now to FIGS. 1B and 7A, a flow chart is shown for one mode of operating the firearm 10. In this embodiment the safety system is maintained in a standby position as indicated by block 142 wherein the interrupter 30 is in its safe position. The safe position comprises the interrupter 30 being at a position to prevent the firing mechanism 16 from firing the firearm. In an alternate embodiment, such as for law enforcement use, the standby position could have the interrupter at its firing position. If a signal is received by the safety system at communicator 36 as indicated by block 144, the controller 32 determines if the received signal matches or corresponds to a stored authorization signal stored in the memory 46 as indicated by block 146. If the received signal does not match the stored signal, the firearm stays at standby 142. If the received signal matches the stored signal, the controller 32 then determines if the grip switch 34 is being actuated as indicated by block 148. If the grip switch 34 is not actuated, the firearm stays at standby 142. If the grip switch 34 is actuated, the safety system moves the interrupter 30 to its firing position, as indicated by block 150, to allow the firearm to fire. A loop is then established between blocks 150 and 148 as indicated by line 152. So long as the grip switch 34 is actuated the interrupter 30 will remain at its firing position without any addition signal reception. The initial signal reception was all that was required and, whether or not the interrupter stays at the firing position is subsequently solely determined upon whether or not the grip switch is actuated. If the grip switch is released, the firearm reverts back to the standby 142 unless and until the safety system is reset by going through process 144, 146, 148 again. Thus, the operation of the firing mechanism is enabled by an initial authorization signal reception and subsequent continuous actuation of the grip switch. If there is a break in the continuity of the actuation of the grip switch 34, the operation of the firing mechanism is permanently disabled until reset by the reception of the initial authorization signal again and the continuous actuation of the grip switch again. The communicator 36 is intended to only obtain the authorization signal from the docking station 60. In this embodiment the signal is an electrical signal comprising an authorization code which is transmitted to the communicator 36 by the connector 80, through the connectors 54, 56, and wire 58. Thus, the firearm 10 must be mounted in the firearm receiving area 64 in order to receive the authorization signal. This type of system would be used in a home environment for home defense. An owner can enable the firing mechanism, but if the firearm is taken away from the owner by an intruder, the grip switch being released during the take away, the firing mechanism is automatically disabled. The firearm can only be enabled if mounted to the docking station and, only after a proper PIN number is entered or identification of an authorized user is verified. The signal transmission between the firearm and the docking station could also be optical, radio frequency, or magnet code. Thus, the firearm does not need to be directly mounted on the docking station to receive the signal. Preferably, the firearm will not function if the interrupter is removed, such as if the firearm is stolen and attempted to be modified.

Figure 7B:
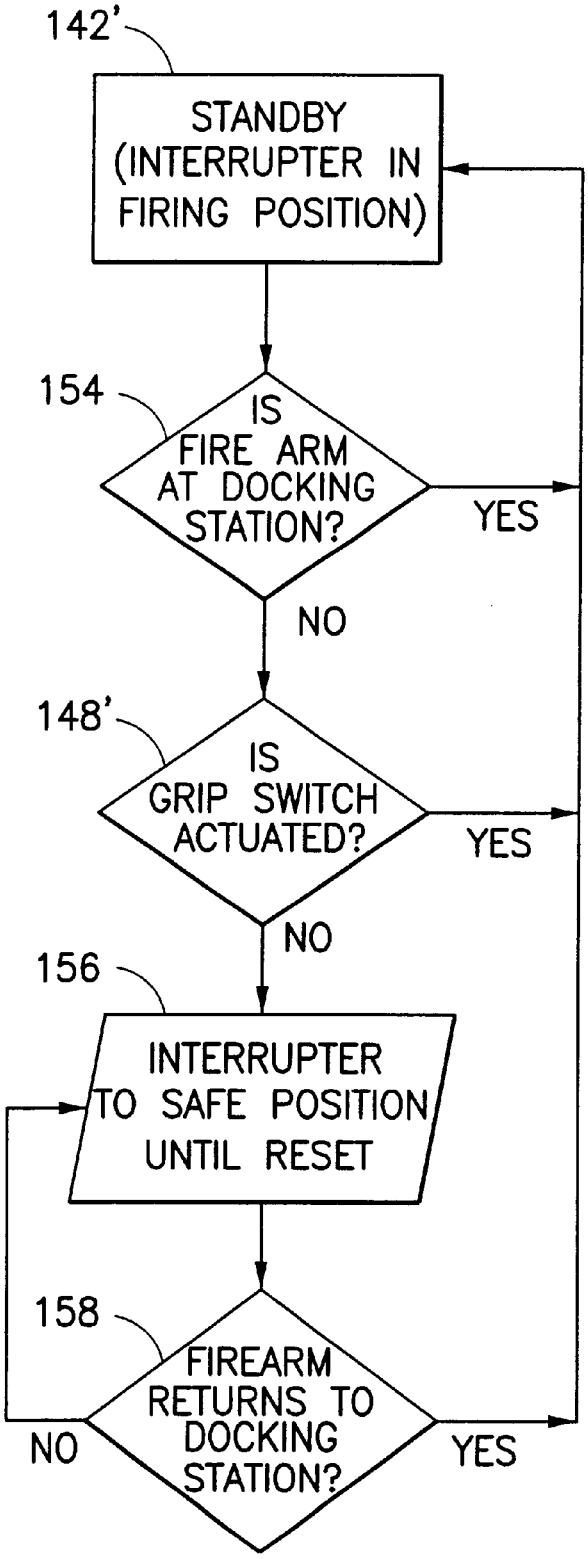
FIG. 7B is a flow diagram of another mode of operating the firearm component of the safety system shown in FIG. 1B with the docking station shown in FIG. 4.

Referring also to FIG. 7B a flow chart for an alternate mode of operation is shown. In this embodiment the firearm is designed to have a standby mode 142' with the interrupter 30 in a firing position, such as for use by law enforcement. The firearm system determines at block 154 if the firearm 10 is at the docking station 60. If the firearm is at the docking station, the firearm stays at standby 142'. If the firearm is not at the docking station, the firearm 10 then determines if the grip switch 34 is actuated as indicated by block 148'. If the grip switch is actuated, the firearm safety system stays at standby 142'. If the grip switch is not actuated, or is released after removal of the firearm from the docking station, the interrupter moves to the safe position, as indicated by block 165, until the safety system is reset. In order to reset the safety system, the firearm system merely determines whether or not the firearm 10 is returned to the docking station 60 as indicated by block 158. If the firearm is not returned, the interrupter remains at the safe position. If the firearm is returned, the safety system returns to standby 142' and the interrupter 30 is moved back to the firing position.

Figure 7C:
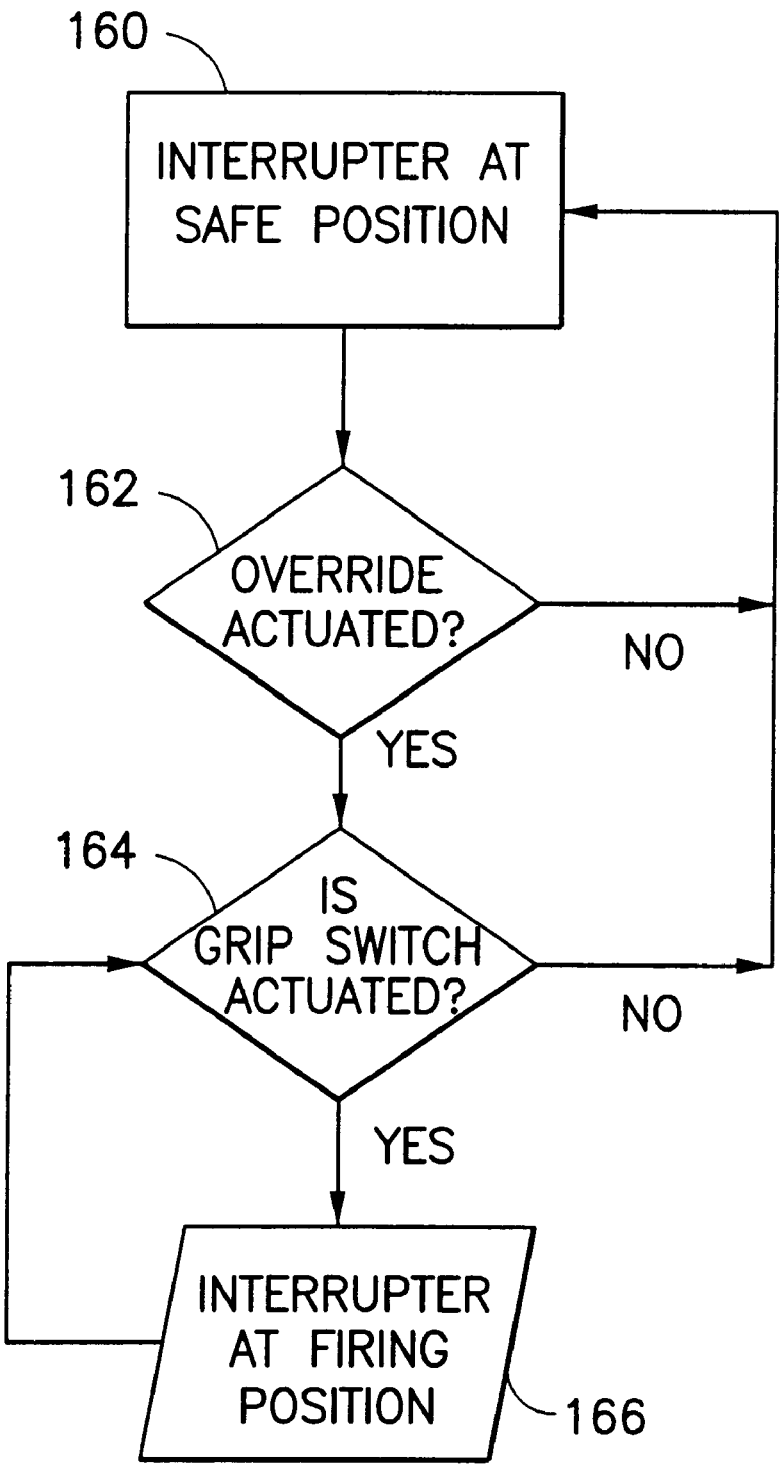
FIG. 7C is a flow diagram of another mode of operating the firearm component of the safety system shown in FIG. 1B with the docking station shown in FIG. 4.

Referring now to FIGS. 1B and 7C, operation of the firearm 10 with the emergency override 38 will be described. If the interrupter is at the safe position as indicated by block 160, the firearm 10 then determines if the override 38 has been properly actuated as indicated by block 162. The override 38 could be an electronic device connected to the controller 32, such as by line 40, mechanically connected to the interrupter as indicated by line 41, or mechanically connected to the firing mechanism 16. If the override 38 has not been actuated, the interrupter 30 remains at its safe position. If the override 38 is actuated, the firearm 10 then determines at block 164 if the grip switch 34 is actuated. The grip switch 34 may be electrically connected to the controller 32, mechanically connected to the interrupter 30, and/or mechanically connected to the firing system. If the grip switch is not actuated, the interrupter remains at the safe position. If the grip switch is actuated, the interrupter is moved to its firing position to allow the firearm to fire without being returned to the docking station as indicated by block 166. So long as the grip switch is actuated, the firearm firing mechanism is enabled. As soon as the grip switch is released, the interrupter returns to the safe position again. This type of emergency override system could be used for a shotgun where the docking station is in a police car and could be used such as when the police officer inadvertently released the grip switch during reloading of the shotgun. It could also be used in a handgun. A control or input device for the override 38 could be a keypad on the firearm or push buttons on the firearm wherein a code or sequence would need to be entered to activate the override 38.

Referring now to FIGS. 1 and 8 an alternate embodiment of the firearm system will be described. This embodiment comprises a docking station 170 and the firearm 10. The docking station 170 comprises a holster frame 172 and a communicator 174. The communicator is located on the holster frame 172. The holster frame 172 is adapted to hold the firearm 10 to be carried by a user, such as a police officer. The firearm 10 includes a communicator 36'. The communicator 36' and the communicator 174 are adapted to communicate with each other when the firearm 10 is located in the holster frame 172. The communication could be. magnetic, electrical, or optical. The communicator 174 could be connected to a controller (not shown) such as the controller 78. Alternatively, the communicator 174 could merely be a transponder (radio frequency or magnetic code) or merely a magnet, such as when the communicator 36' is merely a magnet read switch. This type of embodiment could use the methods described with reference to FIGS. 7A or 7B. If the user, such as a police officer, temporarily releases the grip switch after the firearm is removed from the holster frame 172, the officer can re-enable or reset the firing mechanism by merely inserting the firearm 10 back into the holster frame. Thus, an officer can relatively easily re-enable the firing mechanism, but a criminal taking away the firearm from the officer after the officer removed the firearm from the holster, would have to insert the firearm into the officer's holster before the criminal could use the firearm against the officers. This would be very unusual for a criminal to do and may give the officer sufficient time to subdue the criminal without being injured by his own firearm or at least delay the criminal from fleeing before additional officers arrive.

Figure 9A:
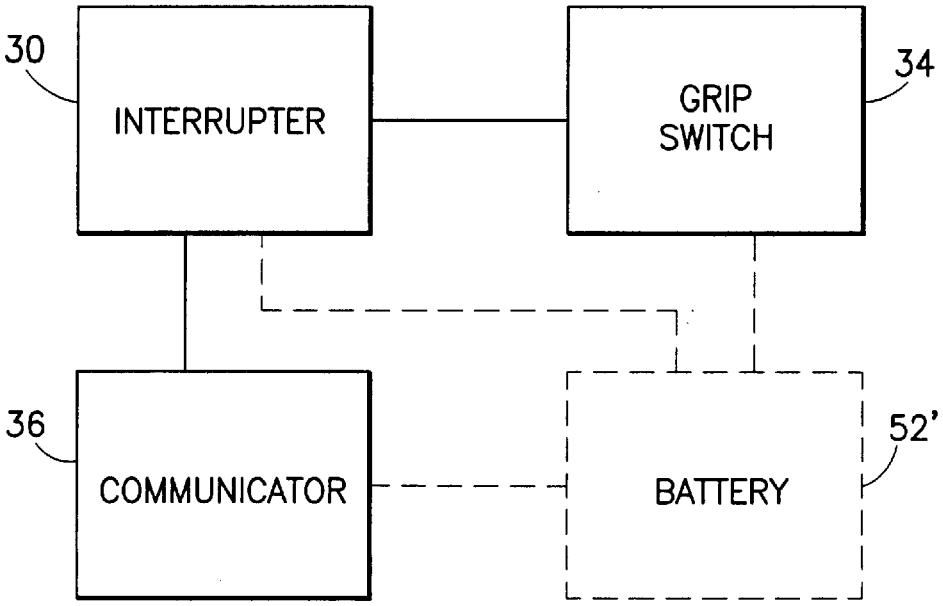
FIG. 9A is a schematic block diagram of an alternate embodiment of the firearm component of the safety system for use with the docking station of either FIGS. 4 or 8.
Figure 9B:
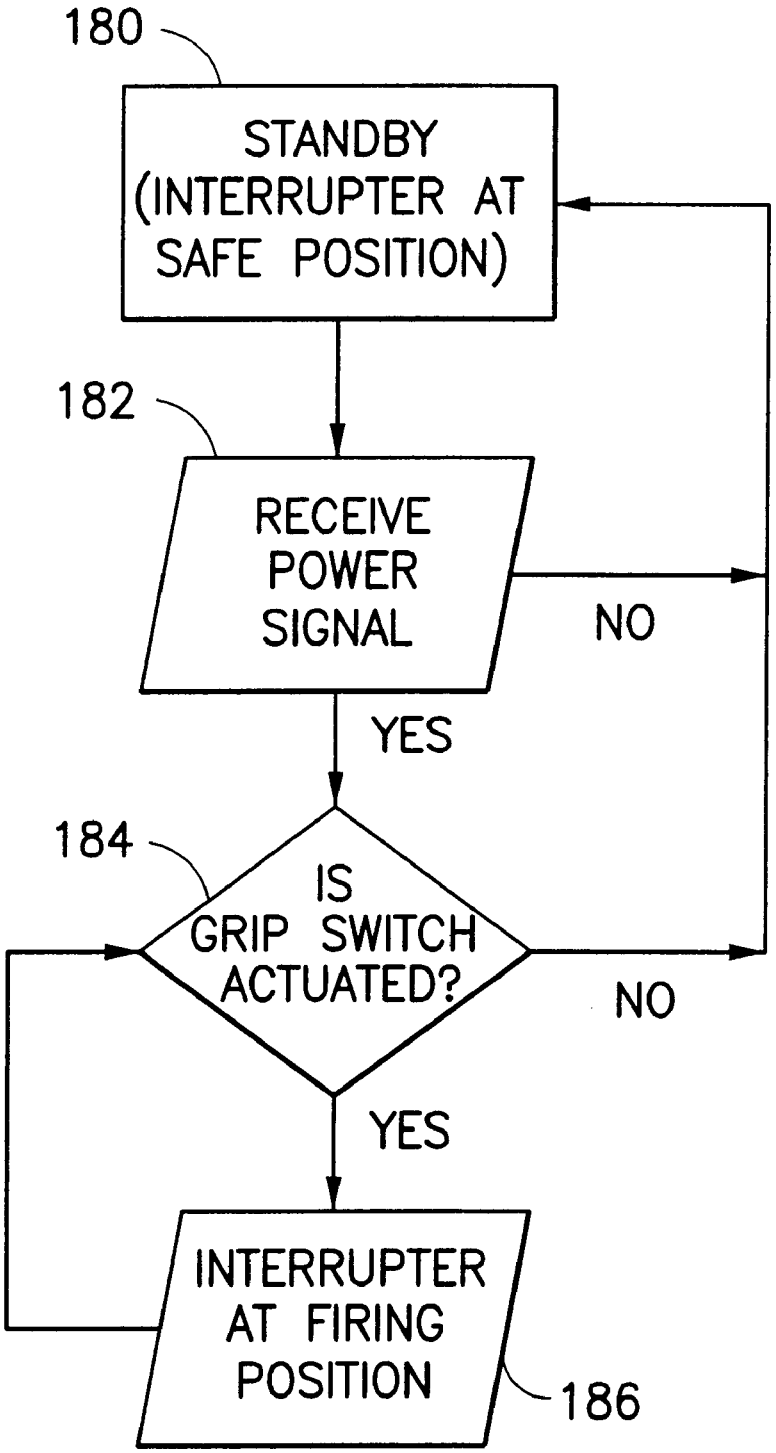
FIG. 9B is a flow diagram of another method of operating the safety system when driving electrical power is used as the signal from the docking station to the firearm.

Referring now to FIG. 9A an alternate embodiment of the firearm component of the safety system is shown. In this embodiment, the safety system has the interrupter 30, the grip switch 34 and the communicator 36. The firearm could also have a battery 52'. The battery 52' could be located in the cartridge magazine or attached to the main frame of the firearm. The battery 52' could be connected to the interrupter 30, grip switch 34 and/or communicator 36. Alternatively, the firearm need not have a battery. In this embodiment the firearm component of the safety system does not include a controller such as controller 32. Instead, the communicator 36 is adapted to receive a power signal from the docking station. This power signal is used to drive or power the interrupter 30. In an alternate embodiment the power signal could be used to power or drive a switch to connect the interrupter 30 to the battery 52' and thereby cause the interrupter 30 to be moved. Preferably, the interrupter 30 is biased by a spring at a first position and moved to a second position when supplied with electrical power, such as a solinoid or micromotor. Thus, communication between the docking station and the firearm does not include a coded authorization signal. Instead the authorization signal is merely non-coded electrical power sent from the docking station to the communicator. Thus, the firearm could be less expensive to manufacture (manufactured without a microprocessor or memory), but safety is still provided by the docking station initialization routine for enabling the firing mechanism and subsequent permanent disablement from release of the grip switch until reset. As seen in FIG. 9B, the firearm component of the safety system could ordinarily be in a standby mode 180 with the interrupter at a safe position. If no power signal is received at the communicator 36, as indicated by block 182, the firearm stays in its standby mode. If a power is received by the communicator from the docking station, then the firearm determines if the grip switch 34 is actuated as indicated by block 184. If the grip switch 34 is not actuated, the firearm remains at standby. If the grip switch is actuated then, as indicated by block 186, the interrupter 30 is moved to the firing position and remains there until the grip switch is released. If the grip switch is released, the firearm must be returned to the docking station to receive the power signal again at block 182 before the interrupter 30 can be moved back to the firing position again. Of course, the firearm could have an emergency override as in FIG. 1B and 7C. As another alternative the user could have a separate power source in the user's pocket to connect to the communicator 36 for use in emergencies. In this alternate embodiment the separate power source and communicator 36 could have a keyed configuration to prevent non-keyed power sources from being used. In another alternate embodiment a mechanical interface between the docking station and the firearm could be used to initialize the safety system in the firearm rather than using a coded signal, magnetism or electrical power from the docking station. However, if the grip switch is subsequently released, the firearm would need to be returned to the docking station for re-enablement of the firearm. For example, pins on the docking station could move into receiving holes in the firearm to mechanically move the interrupter in a coded fashion (similar to a punch card). Different depths of pins could also be used or other mechanical coding for keying purposes could be used.

The present invention provides a new systems approach for solving the problem of limiting gun use to authorized person. Since this system involves making the gun incapable of being fired unless activated at a gun dock, through an authorizing process, one overcomes the big disadvantage of trying to package all of the electrical or electronic processing on the gun itself. Additionally improved algorithms make the authorizing process quicker and more reliable. Finally, the system is generic enough to incorporate advances in biometric identification sensors when they become commercially available. The algorithms are designed to automatically account for the enhanced statistical accuracy of the new sensor approach.

The gun can be stored in any convenient location and the gun dock can also likewise be stored in any convenient location. Access to the gun and the authorization process should take just seconds in most scenarios. A gun which is put down after it has been activated by an authorized user immediately becomes locked and unavailable for use without reactivation. If the docking system authorization system utilizes a biometric identification measurement system then unauthorized persons cannot use a found key or learn of the combination for activating the gun and successfully activate it. If a criminal or intruder takes the gun of this system away from the authorized user, it automatically becomes inactivated and can no longer be fired. Users do not need to wear a ring, watch, or wristband. Users may wear gloves as long as the biometric identification measurement system on the dock does not utilize fingerprint processing. The only electrical components required for one type of the gun is a switch, actuator system, battery, electrical contacts, and electrical conduits/wires. These are much easier to package in the small size and make reliable in close proximity to firing the gun than other electromechanical gun concepts. The processing of biometric data does not have to be located on the gun making it much easier to develop power sources and circuit boards for the sensor processing and matching computations to the authorized person(s). This invention has improved processing algorithms for matching biometric identification measurements against authorized and unauthorized users. The algorithms can combine the data from multiple sources and utilize matches with unauthorized persons and well as authorized person. This system is much easier to manufacture, test, and distribute than other systems. User training and use of this system is more obvious and easier to accomplish as well. By packaging the complicated electronics and processing into a docking system which has access to line power the complexity is greatly reduced.

In accordance with the present invention a gun docking system comprises a gun which cannot be activated for use without locating the gun in the docking station and completing an activation process. The activation process can be designed to identify authorized persons only. There are several option and versions available with this invention which makes it particularly flexible for permitting use only by authorized persons with a very high reliability, accuracy and precision.

The user can program the gun docking station and enter commands for authorizing use on the keypad 28. This keypad can either be a phone pad style with numbers and function keys or a full miniature computer style keyboard. The status of the gun dock during use or programming can be shown on an optical alphanumeric display 76. Additionally, information about the status of the dock can also display with optional lights 74. The gun dock is powered by line current using a standard plug. The system also can use a battery backup system for power outages. The gun docking station can also be programmed externally for various options and tuning the coefficients of the algorithm or updating the software via an optional computer interface 86.

The gun docking station in the embodiment illustrated in FIG. 4 has several biometric identification sensors. A microphone is included for listening to voice to match authorized or unauthorized users with pre-stored voice samples. An optical sensor for comparing fingerprints to match authorized or unauthorized users with pre-stored fingerprint samples. Other biometric identification sensors could be included which match skin conductivity, hand form factor, personal area network (PAN) characteristics, smart credit card, retinal eye pattern, and DNA. The ammunition clip that goes in a generic pistol could have the battery, dock contact, electrical conduit/wires, and internal gun contact. The internal gun contact mates alongside a contact within the gun with the ammunition clip inserted into the gun.

Logic of a gun switch could be as follows:

GUN SWITCH LOGIC CHART

| Current Gun State | Gun Grip Switch | Dock Activation Switch | New Gun State |
|---|---|---|---|
| off | off | off | off |
| off | on | off | off |
| off | off | on | off |
| off | on | on | on |
| on | on | on | on |
| on | on | off | on |
| on | off | on | on |
| on | off | off | off |

The current gun state is the prior state of the gun. The gun is either activated (on) or inactivated (off). The gun grip switch is either depressed (on) or not depressed (off). The gun docking station has either recognized the person as authorized (dock activation switch on) or has not authorized a person (dock activation switch off). If multiple sensors are used, the data can be statistically combined or fused for all of the positive ID probabilities. Simultaneously, the data can also be compared against its stored negative ID data. If multiple sensors are used the data can be statistically combined or fused for all the negative ID probabilities as well as the positive ID probabilities.

A positive ID probability is that an input data set (voice, fingerprint, skin conductivity profile, etc.) matches the stored data for a person or persons who are authorized to use the gun. The negative ID probability is the probability that an input data set (voice, fingerprint, skin conductivity profile, etc.) matches the stored data for a person or persons who are not authorized to use the gun. This is much more robust approach as you can specify thresholds for which you may have a positive ID and thresholds you may have a negative ID (ID of an unauthorized person). For example, a parent may want to store his or her positive ID profiles for voice, fingerprints, etc. in the gun docking station memory. The parent may want to also save the ID profiles for voice, fingerprints, or etc. for their children who are not authorized to use the gun. Then this algorithm not only returns a probability of a positive ID but a probability that it does not match a person who the parent wants to specifically deny access.

The present invention can include an algorithmic approach for combining the various sensor inputs using statistics and stochastic theory. That is, the probabilities are combined using independent and dependent correlations such that every additional sensed input adds more value to the estimation of the probability than the sum of the parts individually.

From the description above, a number of advantages of the gun docking system become evident. Personal ID technology for authorizing a user of the gun is contained within the docking system and not the gun. The docking system permits the use of several methods of identifying an authorized user. Examples given in these embodiments include: personal identification numbers (PIN's) through a keypad; voice identification through a microphone, fingerprint ID through an optical sensor, skin conductivity profiles, and etc. This technology can use one or more methods for authorizing a person and the probabilities are generally improved than just taking the highest of the set. If new technologies are developed which can biometrically identify an individual, the algorithm is capable of incorporating additional multiple sources of identification probabilities as new sensor sources become available. If a gun is laying on a table or in storage, it is incapable of being fired. It can only be activated for firing if the gun is held, put in the gun dock, and authorized person is identified by the gun dock. The algorithm developed for this invention can also determine the probability that the person identified is a person who is not authorized. This increases the probability of blocking an unauthorized person, such as a specific child, from gaining access to an activated gun. The amount of electronics and electromagnetics in the gun is minimized. Therefore reliability is maximized and the need to design in resistance of the electromechanical components to firing explosions is minimized. The gun can be locked into the dock and stored in this manner if desired. The docking station can use line power with battery back-up, which provides a much more robust system for operating the electronics. The system can be easily programmed by a computer. The system is easily adapted to a holster configuration. The system has backup modes for authorizing in case a biometric system fails. The comparison data and performance parameter can be easily tuned by the operator through the keypad and displays.

Accordingly, the reader will see that the gun and the gun docking system can be used together to reduce greatly the unauthorized use of such guns and make them safer. Persons will not be able to use a gun unless the gun has been docked in the docking station, gripped, and the person has successfully passed an electronic authorization. The dock permits the use of keys, PIN numbers, and biometric measurements as a means of electronic authorization. Biometric measurements are sensed personal quantities which distinguish one person from another. The gun docking system allows one or more methods to be employed to electronically authorize a person.

The algorithms developed to implement the docking system include the ability to fuse or combine together data from multiple sources. Additionally, the algorithm allows the setting of thresholds of probability of identification of an authorized user. Furthermore, the algorithm allows the setting of thresholds of insuring that is not a specifically identified non-authorized person, such as a child.

The gun docking system is much easier t o package and build than including authorization technology in the gun. The docking station can easily accommodate one or more au thorization technologies. The docking system can be used to lock the gun down. The docking system does not have to be made resistant to explosions from firing. The docking system can use line power with a battery back-up, making it easier to accommodate new technologies as they are developed. The docking station concept is easy to modify with onboard keyboard and display or through a computer interface.

An advantage of this system is that the gun designed for this system cannot be fired unless activated. Therefore, a gun laying on a table or in storage that is discovered by an unauthorized person is very much less dangerous. This system can be adapted to a holster system for use by private individuals, law enforcement officials, or military personnel. The docking system itself can take many different shapes and forms and could include a variety of electronic authorization and biometric identification measurement approaches.

Although the description above contains many specificities, these should not be construed as limited the scope of the invention, but as merely providing illustrations of some of the presently preferred embodiments of this invention. For example, the docking station can take many forms, mate with the gun many ways, lock the gun in several different fashions, have a variety of different displays, input devices, lights, switches, keys, and computer interfaces. The gun can interface with direct contact or through proximity switches using magnetics, electromagnetics, or radio frequency communication.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A firearm system comprising:

a firearm having a safety system;

a docking station for communicating with the safety system of the firearm;

means for initially moving the safety system to a firing position while the docking station communicates with the safety system;

means for subsequently maintaining the safety system in the firing position, after the means for initially moving has moved the safety system to the firing position, while a user contacts a portion of the firearm; and means for moving the safety system from the firing position to a non-firing position to prevent the firearm from firing when the user releases contact from the portion of the firearm and for maintaining the safety system at the non-firing position until the means for initially moving the safety system is used again to move the safety system back to the firing position.

2. A system as in claim 1 wherein the portion of the firearm is a grip switch.

3. A system as in claim 1 wherein the docking station comprises at least one user input device.

4. A system as in claim 3 wherein at least one of the user input device is adapted to input biometric information into the docking station.

5. A system as in claim 3 wherein the docking station has a memory and a computer for comparing data stored in the memory to information input at the at least one user input device and outputting a signal to the firearm upon a predetermined correspondence of the stored data to the input information.

6. A system as in claim 1 further comprising a manually actuatable emergency override system on the firearm for moving the safety system to the firing position.

7. A system as in claim 1 wherein the docking station comprises a holster frame and the means for initially moving comprises an output on the holster frame and a corresponding input on the firearm.

8. A system as in claim 7 wherein the output comprises a magnet and the input comprises a magnetically moved switch.

9. A method for enabling and disabling a firing mechanism of a firearm, the method comprising steps of:

enabling the firing mechanism by placing the firearm in a firearm docking station and actuating a user actuated switch on the firearm to thereby move a safety system of the firearm to a firing position;

removing the firearm from the docking station while the user actuated switch is actuated, the safety system being continuously maintained in the firing position while the user actuated switch is continuously actuated after removal of the firearm from the docking station; and disabling the firing mechanism by deactuating the user actuated switch by the user to thereby move the safety system to a safe position to prevent the firing mechanism from firing and maintaining the safety system in the safe position until the firearm is once again placed in the docking station and the firing mechanism enabled again.

10. A method as in claim 9 wherein the user actuated switch is a grip switch on the firearm, wherein the grip switch is actuated when the user grasps a hand grip portion of the firearm and the grip switch is deactuated when the user releases contact with the grip switch thereby disabling the firing mechanism.

11. A method as in claim 9 wherein the step of enabling comprises the user entering information into at least one input device of the docking station.

12. A method as in claim 11 wherein the step of enabling comprises the docking station comparing the information entered by the user to information stored in a memory of the docking station.

13. A method as in claim 11 wherein the step of entering comprises entering biometric information from the user into the input device.

14. A method as in claim 9 wherein the step of enabling comprises the docking station sending an enabling signal to the safety system of the firearm.

15. A method as in claim 14 wherein the docking station comprises a holster frame and the enabling signal is sent from the docking station to the safety system when the firearm is in the holster frame.

16. A firearm docking station comprising:

a housing having a firearm docking area for placing a portion of a firearm;

a connector located at the firearm docking area for making a connection with the firearm;

a controller located in the housing and, connected to the connector, the controller comprising a memory; and a user input device connected to the controller, wherein the controller compares input from the user which is entered at the input device to the data stored in the memory and, upon a predetermined correspondence between the input and the data, sends a signal to the connector for transmission of the signal to the firearm at the firearm docking area and, wherein the signal is a firearm firing mechanism enabling signal to allow the firearm to be removed from the firearm docking area with a firing mechanism of the firearm enabled.

17. A firearm docking station as in claim 16 wherein the input device is a biometric information input device.

18. A firearm docking station as in claim 16 wherein the signal is a coded electrical signal.

19. A firearm docking station as in claim 16 wherein the signal is a power signal for powering a drive in the firearm.

20. A firearm docking station as in claim 16 wherein the docking station has at least one other different type of user input device.

21. A firearm docking station as in claim 20 wherein the controller is configured to send the signal to the connector only if the input from both of the user input devices corresponds to a minimum combined identification probability threshold relative to data stored in the memory.

22. A firearm docking station as in claim 16 further comprising a firearm lock for locking the firearm to the housing, wherein the lock is connected to the controller and the lock is configured to be unlocked by the controller.

23. A firearm docking station comprising:

a housing having a firearm docking area for placing a portion of a firearm;

a connector located at the firearm docking area for making a connection with the firearm;

a controller located in the housing and connected to the connector, the controller comprising a memory; and a device connected to the controller for inputting information into the memory for programming the controller.

24. A docking station as in claim 23 wherein the device is a keypad connected to the housing.

25. A docking station as in claim 23 wherein the device is an electrical connector on the housing for connecting the controller to a computer.

* * * * *